United States Patent [19]

Bartz

[11] 3,962,057

[45] June 8, 1976

[54] METHOD OF IMPARTING CONTRAST TO A MICROSCOPE OBJECT

[75] Inventor: Günter Bartz, Wetzlor, Germany

[73] Assignee: Ernst Leitz G.m.b.H.

[22] Filed: June 7, 1974

[21] Appl. No.: 477,188

Related U.S. Application Data

[62] Division of Ser. No. 262,082, June 12, 1972, Pat. No. 3,859,535.

[30] Foreign Application Priority Data

June 21, 1971 Germany ..... 2130605

[52] U.S. Cl. ..... 204/164; 204/165

[51] Int. Cl.[2] ..... B01K 1/00

[58] Field of Search ..... 204/164, 168, 165

[56] References Cited

UNITED STATES PATENTS

| | | | |
|---|---|---|---|
| 2,935,418 | 5/1960 | Berthold et al. | 204/168 |
| 3,171,539 | 3/1965 | Holbrook et al. | 204/168 X |
| 3,308,049 | 3/1967 | Jones et al. | 250/531 |
| 3,418,229 | 12/1968 | Lakshamanan et al | 204/192 |
| 3,477,936 | 11/1969 | Gillery et al. | 204/192 |
| 3,600,122 | 8/1971 | Coleman | 204/168 X |
| 3,604,970 | 9/1971 | Culbertson et al. | 313/107 |

*Primary Examiner*—F.C. Edmundson
*Attorney, Agent, or Firm*—Krafft & Wells

[57] ABSTRACT

The method of imparting contrast to the surface of an object to be viewed microscopically comprises the steps of introducing the object into a vacuum chamber, connecting the object to the positive pole of a high voltage d.c. source, evacuating the chamber, bombarding the surface of the object with a gas-concentrated electron-ion beam, and feeding into the chamber a gas which reacts chemically with the bombarded object surface. Under the effect of the electron beam and negative or neutralized ions a reaction layer then forms which is characteristic of the component parts of the object material. This layer, after the conclusion of the contrasting process can be observed and evaluated under a microscope.

5 Claims, 1 Drawing Figure

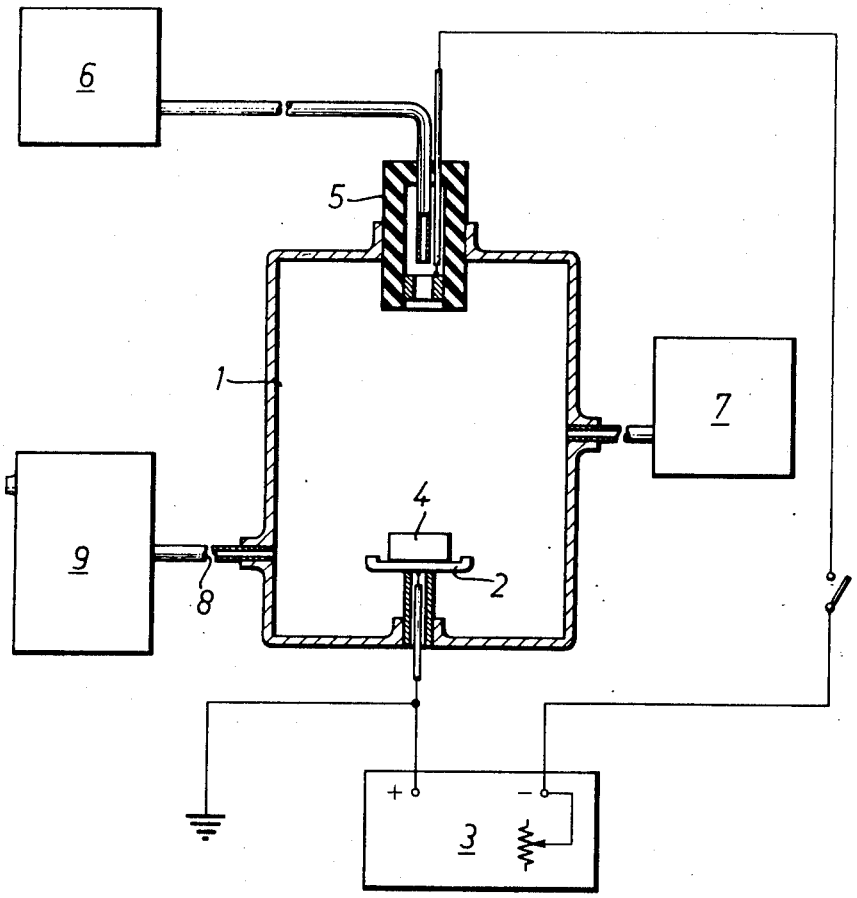
6
5
1
7
4
9
2
8
+
−
3

METHOD OF IMPARTING CONTRAST TO A MICROSCOPE OBJECT

CROSS REFERENCES TO RELATED APPLICATION

The present application is a division of application Serial No. 262,082, filed June 12, 1972, now U.S. Pat. No. 3,859,535.

BACKGROUND OF THE INVENTION

The invention relates to a method of producing a specimen for microscopic investigation having a surface contrast, especially a color contrast, which is characteristic of the component parts of the specimen material.

In biological investigations it is well known to produce a color contrast in thin sections by staining the section with a suitable dye. This method fails, however, if the contrast is to be produced on a non-biological specimen. There are, of course, several methods known by which a contrast may be generated on the surface of a non-biological specimen, however, all these methods have serious disadvantages. There are, for example, the methods of wet etching and of anodic etching for generating colored layers on the specimen. However, these methods are limited to a few particular applications. By the so-called annealing etching method thin colored oxide layers are produced on the object surface by heating the object in a special oven. But only few objects are suitable for this kind of operation.

Further, a method of producing thin, highly refracting and light-transmissive layers on the object is known, which layers amplify considerably the natural object contrast. The layer is produced by evaporation in a high vacuum. This method, however, is only applicable in scientific research and not in routine investigations, on account of the great expenditures both of apparatuses and time.

In the so-called cathodic etching the object is bombarded in a high vacuum by high-energy positive ions with the object being connected to the cathode. The structure of the object become visible mainly by different erosion of the component parts of the object. Subsequent oxydization by positive air or oxygen ions will highly amplify the contrast. However, the exact relation between the grey shades or the color and the chemical material is greatly lost by the ion-etching.

It is, therefore, an object of the present invention to provide a simple, effective method of producing contrast, especially color contrast, on the specimen to be examined. it is a further object to provide a method which consumes only little time. And it is a further object to provide a method which may be carried out under microscopic examination so that the user may establish the process and object conditions most favorable for the specific task.

SUMMARY OF THE INVENTION

According to the present invention, there is provided a method of imparting contrast to a surface portion of an object to be investigated microscopically, comprising the steps of introducing the object into a vacuum chamber, connecting the object to the positive pole of a regulable high voltage direct current source, at least partially evacuating the chamber, bombarding a surface portion of the object with at least one gas-concentrated electron-ion-beam, and feeding into the chamber, gas which reacts chemically with the bombarded surface portion of the object.

In addition to the above steps the divergence of the impinging ion beam may be varied during the process and different gases may be introduced into the chamber successively. However, the gases may also be introduced simultaneously as a mixture. Further, it is possible to bombard the object simultaneously with the beams of several ion sources. And finally, a relative movement between the object and the impinging beam may be generated.

BRIEF DESCRIPTION OF THE DRAWING

The present invention will be more readily comprehended from the following description when taken in conjunction with the appending drawing which shows an apparatus for performing the invented method.

DESCRIPTION OF THE PREFERRED EMBODIMENT

For carrying out the method, a vacuum chamber 1 is used, which is provided with an object carrier 2, which is connected electrically to the positive pole of a high voltage direct current source 3 and to earth. The object 4 is mounted on the carrier 2. The vacuum chamber 1 is provided with an ion gun 5 of the gas discharge type, which is connected on the one hand with the negative pole of the source 3, on the other hand with a regulatable gas source 6. The vacuum chamber has an inlet 7 through which reagent gas is supplied, and an outlet 8 connected to a vacuum pump 9. After the object 4 is mounted on the object carrier 2 and the vacuum chamber 1 is closed, an underpressure of for example $10^{-3}$ Torr is generated in the vacuum chamber by means of the vacuum pump 9 and maintained. Now the ion gun 5 is operated by switching on the high tension and the gas supply from the source 6. There forms a gas-concentrated beam, the boundaries of which light up. The focussing of this beam is controlled in each case according to the magnitude of the surface portion of the object, which is to be irradiated by the fine regulation of the gas supply from the source 6, for example by means of a needle valve. Simultaneously a gas reacting with the object in a chemical way is supplied via the inlet 7. Under the effect of the electron beam and negative or neutralized ions, a reaction layer characteristic of the component parts of the object material then forms, which after conclusion of the contrasting process can be observed under a microscope and evaluated.

Instead of using, as shown, an individual inlet 7 for the reaction gas, it is possible to feed the gas directly via the ion gun 5. Also, a mixture of different gases may be fed into the chamber during the bombardment of the object.

In order to protect objects against impermissible heating during the reaction, the object carrier may be equipped with a suitable cooling device of known kind. Conversely, it may be desirable to increase the reaction speed and this can be achieved, for example, by heating the object. For this purpose, the object carrier may be provided with a corresponding heating device.

The reaction layers display, in direction towards the object parts not irradiated, a contrast falling off towards the edge. In order to counteract this, means may be provided to effect relative movement between object and beam, which secure an uniform bombardment of all desired object surface portions.

The object may be bombarded simultaneously by beams derived from a plurality of electron-ion-beam sources. The respective beams may then be directed towards the object from different directions and can be arranged to impinge on different surface portions of the object.

It is possible to provide one or more stops or masks in the path of the or each bombarding beam, which cause an exact limiting of the bombarded region.

What is claimed is:

1. A method of imparting contrast to a surface portion of an object to be investigated microscopically, comprising the steps of:

a. introducing the object into a non-grounded vacuum chamber;

b. connecting the object to the positive pole of a regulatable high voltage direct current source;

c. evacuating the chamber to a partial vacuum;

d. bombarding a surface portion of the object with a combined electron-ion gun of the gas discharging type mounted in the wall of the vacuum chamber opposite the object, said combined electron-ion gun having a cathode connected to a negative pole of the direct current source;

e. regulating the gas source connected to the ion gun of the combined electron-ion gun for bombarding the surface portion of the object with a gas concentrated electron-ion beam;

f. adjusting the gas concentrated electron-ion beam to impinge on the object which is electrically conducting; and g. feeding into the vacuum chamber gas which reacts chemically with the bombarded surface portion of the object.

2. A method as claimed in claim 1, wherein different gases are fed into the chamber one after the other.

3. A method as claimed in claim 1, wherein a mixture of different gases is fed into the chamber during the bombardment.

4. A method as claimed in claim 1, wherein the object is bombarded simultaneously by beams derived from a plurality of electron-ion-beam sources.

5. A method as claimed in claim 1, wherein during the bombardment the object is displaced relative to the or each bombarding beam.

* * * * *